US010595705B2

(12) United States Patent
Wegener et al.

(10) Patent No.: US 10,595,705 B2
(45) Date of Patent: Mar. 24, 2020

(54) DISPENSING DEVICE

(71) Applicant: Miele & Cie. KG, Guetersloh (DE)

(72) Inventors: Dirk Wegener, Bielefeld (DE); Guenter Kroeger, Rahden (DE)

(73) Assignee: MIELE & CIE. KG, Guetersloh (DE)

( * ) Notice: Subject to any disclaimer, the term of this patent is extended or adjusted under 35 U.S.C. 154(b) by 394 days.

(21) Appl. No.: 15/361,021

(22) Filed: Nov. 24, 2016

(65) Prior Publication Data

US 2017/0143183 A1 May 25, 2017

(30) Foreign Application Priority Data

Nov. 25, 2015 (DE) ..... 10 2015 120 386

(51) Int. Cl.
*A47L 15/44* (2006.01)

(52) U.S. Cl.
CPC ..... *A47L 15/449* (2013.01); *A47L 15/4463* (2013.01); *A47L 15/4472* (2013.01)

(58) Field of Classification Search
CPC .. G01F 11/006; A47L 15/4472; A47L 15/449; A47L 15/4463
See application file for complete search history.

(56) References Cited

U.S. PATENT DOCUMENTS 6,581,800 B2 * 6/2003 Rodd ..... A47L 15/44 222/144
2002/0117511 A1 8/2002 McNabb et al.
2006/0114128 A1 * 6/2006 Prinz ..... A47L 15/4293 341/22
2007/0194056 A1 * 8/2007 Webster ..... G01F 11/46 222/370
2008/0274025 A1 * 11/2008 Brandt ..... A47L 15/4463 422/261
2010/0000580 A1 * 1/2010 Classen ..... A47L 15/0055 134/93

(Continued)

FOREIGN PATENT DOCUMENTS

DE 102010003769 A1 10/2011
DE 102013104391 A1 10/2014

(Continued)

OTHER PUBLICATIONS

Machine translation of DE 102013104391 A1, dated Oct. 2014. (Year: 2014).*

(Continued)

*Primary Examiner* — Joseph L. Perrin
*Assistant Examiner* — Kevin G Lee
(74) *Attorney, Agent, or Firm* — Leydig, Voit & Mayer, Ltd.

(57) ABSTRACT

A dispensing device for introducing a pourable detergent in metered amounts into a treatment chamber of a program-controlled cleaning appliance includes: a supply container for holding the detergent, the supply container having a reservoir chamber and a metering chamber terminating in a dispensing opening, the metering chamber being fluidically connected to the reservoir chamber via an interposed passage opening; a carrier unit which is rotatable by a motor and replaceably receives the supply container; and a closure device that closes the passage opening at least until the supply container is first put into use.

11 Claims, 18 Drawing Sheets

(56) References Cited

U.S. PATENT DOCUMENTS

2016/0251131 A1* 9/2016 Edwards ..... B65B 3/04
206/524.7

FOREIGN PATENT DOCUMENTS

JP 4965647 U 6/1974
WO 2013113576 A1 8/2013

OTHER PUBLICATIONS

Machine translation of DE 102010003769 A1, dated Oct. 2011. (Year: 2011).*
European Search Report, EP 16 199 453.8, dated Apr. 7, 2017, p. 6.

* cited by examiner

DISPENSING DEVICE

CROSS-REFERENCE TO PRIOR APPLICATION

Priority is claimed to German Patent Application No. DE 10 2015 120 386.3, filed on Nov. 25, 2015, the entire disclosure of which is incorporated by reference herein.

FIELD

The present invention relates to a dispensing device for introducing a pourable detergent in metered amounts into a treatment chamber of a program-controlled cleaning appliance, in particular a dishwasher, the dispensing device having a supply container for holding the detergent and a carrier unit which is rotatable by a motor and replaceably receives the supply container, the supply container having a reservoir chamber and a metering chamber terminating in a dispensing opening, the metering chamber being fluidically connected to the reservoir chamber via an interposed passage opening.

BACKGROUND

Program-controlled cleaning appliances in general, and dishwashers in particular, are per se well known in the art and, therefore, need not be specifically described herein.

Cleaning appliances of type in question typically have a washing tub providing a treatment chamber, also called washing chamber. The treatment chamber is accessible to a user via a loading opening which can be closed in a fluid-tight manner by a pivotably mounted washing chamber door. During normal use, the washing tub serves to receive items to be washed which, in the case of a dishwasher, may be dishes, cutlery items and/or the like.

In order to apply wash water, also called wash liquid, to the items to be washed, the cleaning appliance has a spray device disposed inside the washing tub. This spray device generally provides rotatable spray arms, typically two or three such spray arms. During normal use, wash liquid is applied to the items to be washed by rotating spray arms.

In order to achieve optimized cleaning results, process chemicals are used which are delivered into the washing chamber during a cleaning operation. Typically, the process chemicals are added to the wash liquid. Such process chemicals may, for example, be detergents, which are added into the washing chamber of the cleaning appliance in a program-controlled manner at a particular point in time during the operational cycle, Detergents in liquid and solid form are known in the art. Solid detergents may be in form of pourable powders or so-called tabs; i.e., in tablet form. However, practice has shown that the comparatively best results can be achieved with pourable detergents in powder form.

When pourable detergents in powder form are used, the user must manually measure out the detergent each time before a cleaning cycle is started. For this purpose, a cleaning appliance typically has a supply container which is disposed on the inner side of the door and has to be charged with a manually selected amount of detergent. During operation, this supply container opens at a particular point in time during the wash cycle, allowing the detergent held in the supply container to be washed out by the wash liquid present in the washing chamber of the cleaning appliance.

To be able to store detergent for a plurality of wash cycles, avoiding the need to manually measure out detergent each time before a wash cycle is started, dispensing devices have been proposed, such as the one described in DE 10 2013 104 391 A1.

This known dispensing device has a replaceable supply container for storing an amount of detergent sufficient for a plurality of wash cycles. The supply container is rotatable about an axis of rotation. During a normal dispensing event, the supply container is rotated in a program-controlled manner. For this purpose, a motor-driven drive device is provided which, when operated, causes rotational movement of the supply container. In the process, the motor-driven drive device cooperates with a carrier unit which replaceably receives the supply container.

Dispensing devices of the aforedescribed type have proven practical in everyday use. Nevertheless, there is a need for improvement, particularly with respect to increased operational reliability. It is, therefore, an object of the present invention to improve a dispensing device of the above-mentioned type in a way that provides enhanced operational reliability because of the design.

SUMMARY

In an embodiment, the present invention provides a dispensing device for introducing a pourable detergent in metered amounts into a treatment chamber of a program-controlled cleaning appliance, the dispensing device comprising: a supply container for holding the detergent, the supply container having a reservoir chamber and a metering chamber terminating in a dispensing opening, the metering chamber being fluidically connected to the reservoir chamber via an interposed passage opening; a carrier unit which is rotatable by a motor and replaceably receives the supply container; and a closure device configured to close the passage opening at least until the supply container is first put into use.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
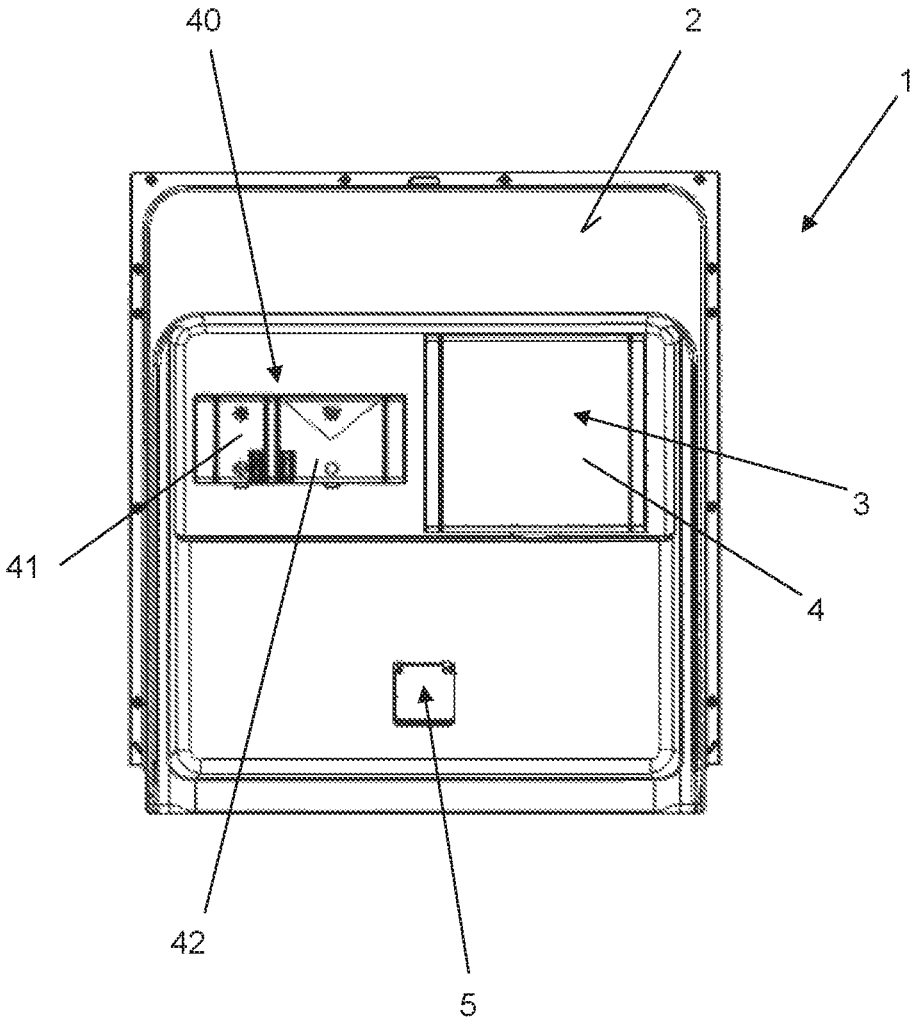
FIG. 1 is a schematic view of the inner side of a washing chamber door of a dishwasher.

In an embodiment, the present invention provides a dispensing device which has a closure device that closes the passage opening at least until the supply container is first put into use.

It has been found that detergent stored in the supply container may clump due to unwanted ingress of moisture, even before first use. Clumping of detergent present in the metering chamber is particularly disadvantageous because this may cause clogging of the dispensing channel and/or blockage of the metering space, making it impossible to introduce metered amounts of detergent into the washing chamber of the cleaning appliance.

The design according to the present invention remedies this problem by providing a closure device that closes the passage opening between the reservoir chamber and the metering chamber, at least until the supply container is first put into use. Thus, using the closure device according to the present invention, it is ensured that the fluid connection between the reservoir chamber and the metering chamber is interrupted. Therefore, detergent stored in the supply container cannot flow over into the metering chamber. If unwanted ingress of moisture should occur, clumping of detergent may occur only in the reservoir chamber, but not in the metering chamber because the closure device provided prevents passage of detergent from the reservoir chamber to the metering chamber. A possible clumping of detergent in the reservoir chamber is not as serious as a clumping in the metering chamber, as may occur in the prior art. This is because, on the one hand, any lumps which may form in the reservoir chamber are broken up during operational rotation of the supply container due to the size of the reservoir chamber and, on the other hand, the metering chamber is divided into a dispensing channel and a metering space, and, therefore, forms a type of labyrinth passage, which is more susceptible to formation of unwanted detergent deposits.

Moreover, since the fluid connection between the reservoir chamber and the metering chamber is interrupted until first use, it is ensured that the detergent can be properly portioned during first use. Thus, the closure device according to the present invention serves also as a storage and shipping closure because it effectively prevents detergent from migrating into the metering chamber prior to first use.

According to a first alternative of the present invention, the closure device has a closure element which is movably disposed on the supply container and is movable from a closed position closing the passage opening to an open position clearing the passage opening, and vice versa. This embodiment allows a user is to open or close the passage opening as desired. Thus, advantageously, the passage opening can be opened and/or closed repeatedly, making it possible to remove the supply container form the carrier unit before it is completely empty, and to close the passage opening thereof, so that the supply container can be reused and/or further used at a later time. Thus, this preferred embodiment of the present invention provides a reclosable passage opening.

The closure element is preferably a wall portion which in shape corresponds to the passage opening and is disposed on a rotatable disk. Accordingly, the closure element is rotatable and can be moved from an open position to a closed position by a user initiating a simple rotational movement. Preferably, the position of the closure element is visually indicated to a user by corresponding markings on the supply container and/or on the closure element, making it possible to ascertain from outside whether the passage opening between the reservoir chamber and the metering chamber is open or closed to fluid flow.

In accordance with a further feature of the present invention, the carrier unit has a coding device cooperating with the closure device. This configuration provides the advantage of ensuring that a supply container can only be properly inserted into the carrier unit when the closure element is in the open position, and thus proper dispensing of detergent in portions is enabled by clearing the passage opening. If the passage opening should still be closed; i.e., if the closure element should still be in the closed position, the coding element provided on the carrier unit prevents the supply container from being properly inserted into the carrier unit.

As an alternative to the formation of a coding device, it is also possible to provide an opening means which is disposed on the carrier unit and cooperates with the closure device. Because of the opening means, the passage opening is advantageously automatically opened as the supply container is inserted into the carrier unit, provided that this has not already been done manually by a user. Thus, the opening means ensures that once the supply container has been properly inserted into the carrier unit, the passage opening is open and the intended use is thereby enabled.

In accordance with another feature of the present invention, the opening means may take the form of a cam having a ramp-shaped cam contour on the supply container side, the ramp-shaped cam contour cooperating with a mating contour provided by the closure device. As soon as the supply container is inserted into the carrier unit with the passage opening closed, the cam contour of the opening means and the mating contour of the closure member come into cooperative contact. Due to the ramped shape of the cam contour, this cooperative contact causes a rotational movement of the closure device, and thus also of the closure element, as a result of which the closure device is automatically rotated as the supply container is inserted into the carrier unit, thereby opening the passage opening.

In an alternative embodiment of the present invention, the closure device is a sealing film, which closes the passage opening until first use. Prior to first use of the supply container, the sealing film must be removed to clear the passage opening; i.e., to make the fluid connection between the reservoir chamber and the metering chamber barrier-free.

To this end, in accordance with another feature of the present invention, the sealing film may be disposed at one end of a tab whose other end extends through the dispensing opening. A user can grasp the tab and pull on it, causing the sealing film at the one end of the tab to be torn open and/or torn off, thereby opening the passage opening.

In an alternative embodiment, the supply container may have a first container part providing the reservoir chamber and a second container part providing the metering chamber, the two container parts being movable relative to each other. Prior to first use, the two container parts have to be brought into their proper position, in which the sealing opening closing the passage opening is torn open and/or removed, which is accomplished by a seal-destroying device provided on one of the container parts. Once the two container parts are properly aligned with each other, the sealing film is destroyed by the seal-destroying device.

In another exemplary embodiment of the present invention, a metering element providing the metering chamber is provided which is movably disposed within the supply container and is movable from a non-metering position to a metering position. It is only when the metering element is in the metering position that detergent can be conveyed from the reservoir chamber into the metering chamber during normal use. Otherwise; i.e., when the metering element is in the non-metering position, it is impossible to convey detergent from the reservoir chamber into the metering chamber. As soon as the supply container is properly inserted into the dispensing device for purposes of first use, the metering element is automatically moved from the non-metering position to the metering position. In the metering position, a fluid connection is established between the reservoir chamber and the metering chamber, so that during a normal dispensing event, detergent held in the reservoir chamber can flow into the metering chamber provided by the metering element. The metering element may in particular be linearly movable, in particular in the height direction of the supply container. Thus, a linear movement of the metering element takes place during operation. A linear movement is structurally particularly simple to implement and cannot be easily disturbed in practical operation. Therefore, this design variant is preferred.

In accordance with a further feature of the exemplary embodiment, the metering element has an inlet opening which cooperates with an outlet opening provided by the supply container when the metering element is in the metering position. Thus, both the metering element and the supply container provide an opening, the two openings cooperating with each other when the metering element is in the metering position. In the metering position, the inlet opening of the metering element and the outlet opening of the supply container are at least partially in register with each other, so that in a metering event, detergent can flow from the reservoir chamber into the metering chamber. As long as the metering element is in its non-metering position, the inlet opening and the outlet opening are not even partially in register with each other, and the wall in which the outlet opening of the supply container is formed serves as a closure element for the inlet opening of the metering element, the closure element interrupting the fluid connection between the reservoir chamber and the metering chamber.

In accordance with this exemplary embodiment, the carrier unit may in particular have an actuating device cooperating with the metering element. This actuating device serves to move the metering chamber from the non-metering position to the metering position as the supply container is properly inserted into the carrier unit. The actuating member may be, for example, a pin which, when the supply container is inserted in the carrier unit, extends through an opening provided by the supply container. Thus, as the supply container is properly inserted into the carrier unit, the actuating device passes through the openings provided in the supply container and comes into actuating contact with the metering element. In response to inserting the supply container into the carrier unit, the metering element is pushed upward in the height direction of the supply container and thereby moved from its non-metering position to the metering position.

In accordance with a further feature of the present invention, in order to enable, to the extent possible, a non-jamming movement of the metering element, two actuating device are provided, so that force can act on the metering element in a uniformly distributed manner.

In accordance with an alternative embodiment of the present invention, the two container parts are rotatable relative to each other via a film hinge interposed therebetween. In this case the seal-destroying device is preferably a short tubular projection. In response to rotating the two container parts relative to each other to properly align them, the short tubular projection serving a seal-destroying device is driven through the passage opening formed on the other container part, as a result of which the sealing film closing the passage opening is removed and/or torn open.

The present invention further provides a supply container adapted for removable placement in a dispensing device having one of the features described above. The advantages described earlier apply equally to a supply container configured in this manner. The supply container may be either refillable; i.e., designed as a reusable container, or designed as a disposable container. In the latter case, no provision is made for the supply container to be refilled by a user.

During normal use of the dispensing device, when the supply container is in the inserted position, detergent is released in portions through its dispensing opening during a dispensing event. Such a release of detergent occurs in response to a rotational movement of the supply container. Each 360° rotation of the supply container causes equal portions of detergent to be fed to the dispensing opening and released from there into the washing chamber of the cleaning appliance via an interposed channel system.

To effect metering of the detergent, the supply container has a reservoir chamber, on the one hand, and a metering chamber, on the other hand. The reservoir chamber is used for storing the detergent, and the metering chamber is used for dispensing the detergent in portions during operation. To this end, the metering chamber is divided into two fluidically connected sections, namely a metering space and a dispensing channel, which are separated by a barrier. The barrier bounds the metering space in such a manner that during a rotational movement of the supply container, first the metering space is filled with an amount of detergent determined by the size of the metering space. During further rotational movement, the amount of detergent introduced into the metering space is conveyed past the barrier into the dispensing channel and toward the dispensing opening without any additional detergent flowing from the reservoir chamber into the metering space. Thus, during normal use, the detergent passes from the reservoir chamber through the passage opening into the metering space of the metering chamber, the size of the metering space determining the portioned amount of detergent. When the supply container is rotated further, the portioned amount of detergent exits the metering space and passes through the dispensing channel to the dispensing opening. During this process, no additional detergent can flow from the reservoir chamber through the passage opening into the metering space of the metering chamber due to the continued rotation of the supply container.

In a manner known per se, dishwasher 100 has a housing 101 that accommodates a washing tub 102. Washing tub 102, in turn, provides a treatment chamber, also called washing chamber 103, to receive items to be washed. To permit loading of washing chamber 103 with items to be washed, washing tub 102 has a loading opening 104. Loading opening 104 can be closed in a fluid-tight manner by a washing chamber door 1, which is supported so as to be pivotable about a horizontally extending pivot axis.

During normal use, wash liquid is applied to the items to be washed. To this end, dishwasher 100 is provided with a spray device 105. In the exemplary embodiment shown, spray device 105 includes an upper spray arm 106 and a lower spray arm 107.

Figure 10:
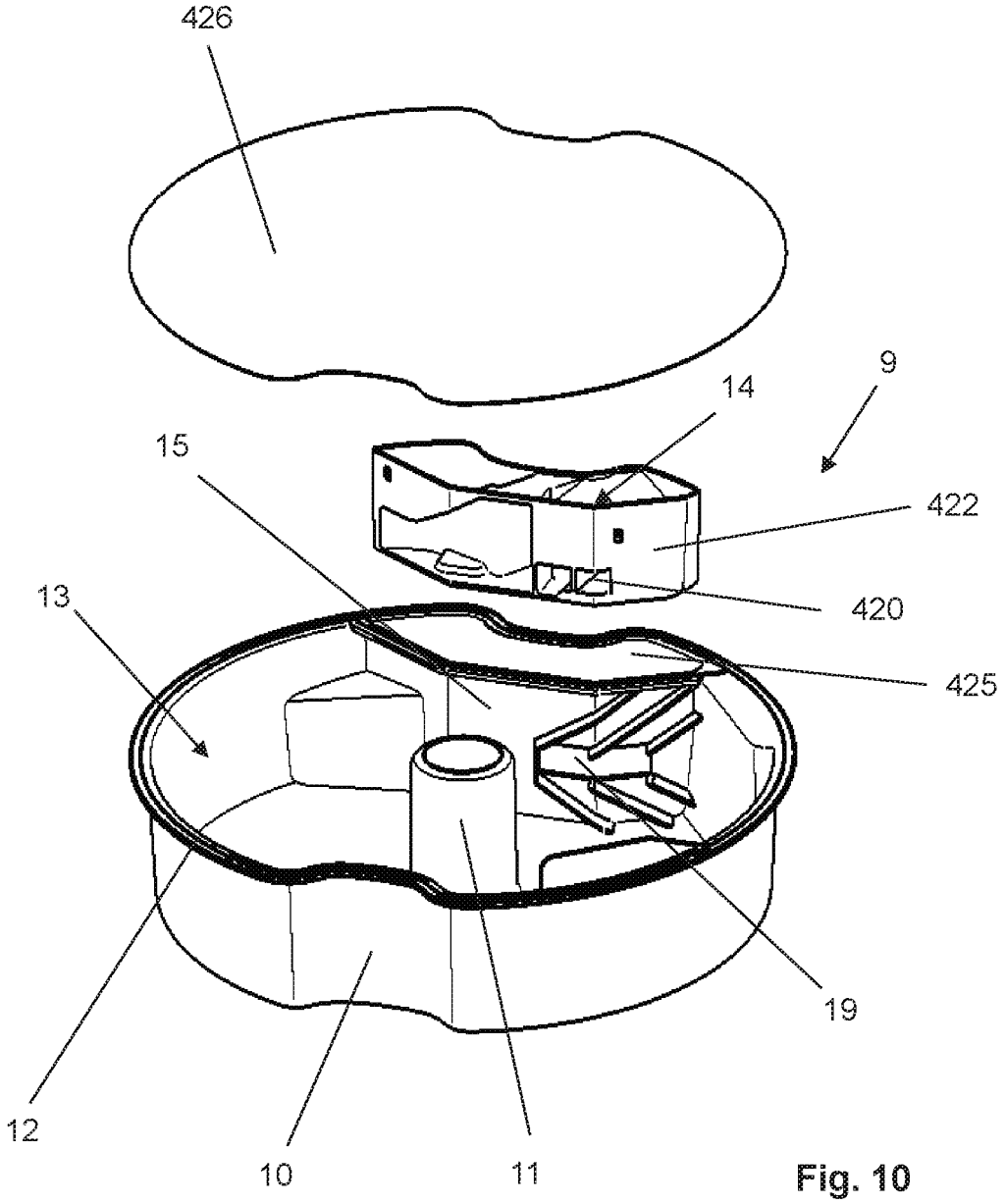
FIG. 10 is a schematic exploded view of an inventive supply container according to a fourth embodiment.

FIG. 1 shows washing chamber door 1 in elevation, looking at the inner side thereof in the direction of view denoted I in FIG. 10.

As can be seen from FIG. 1, washing chamber door 1 is provided on the inner side with a combination device 40 which is generally known in the art and which has a rinse aid reservoir 41 as well as a supply container 42 that has to be filled manually with detergent by a user for each wash cycle.

In addition to the combination device 40 generally known in the art, dishwasher 100 further has a dispensing device 3 which, like combination device 40, is disposed on inner side 2 of washing chamber door 1. When washing chamber door 1 is closed, closing cover 4 of dispensing device 3 is in the closed position, as shown in FIG. 1.

As will be described in greater detail below, dispensing device 3 has a supply container 9 holding pourable detergent. During normal use, detergent is conveyed from supply container 9 into washing chamber 103 of dishwasher 100. To this end, a dispensing outlet 5 is provided on inner side 2 of washing chamber door 1. This dispensing outlet 5 is equipped with a cover or a pivoted cover.

Figure 2:
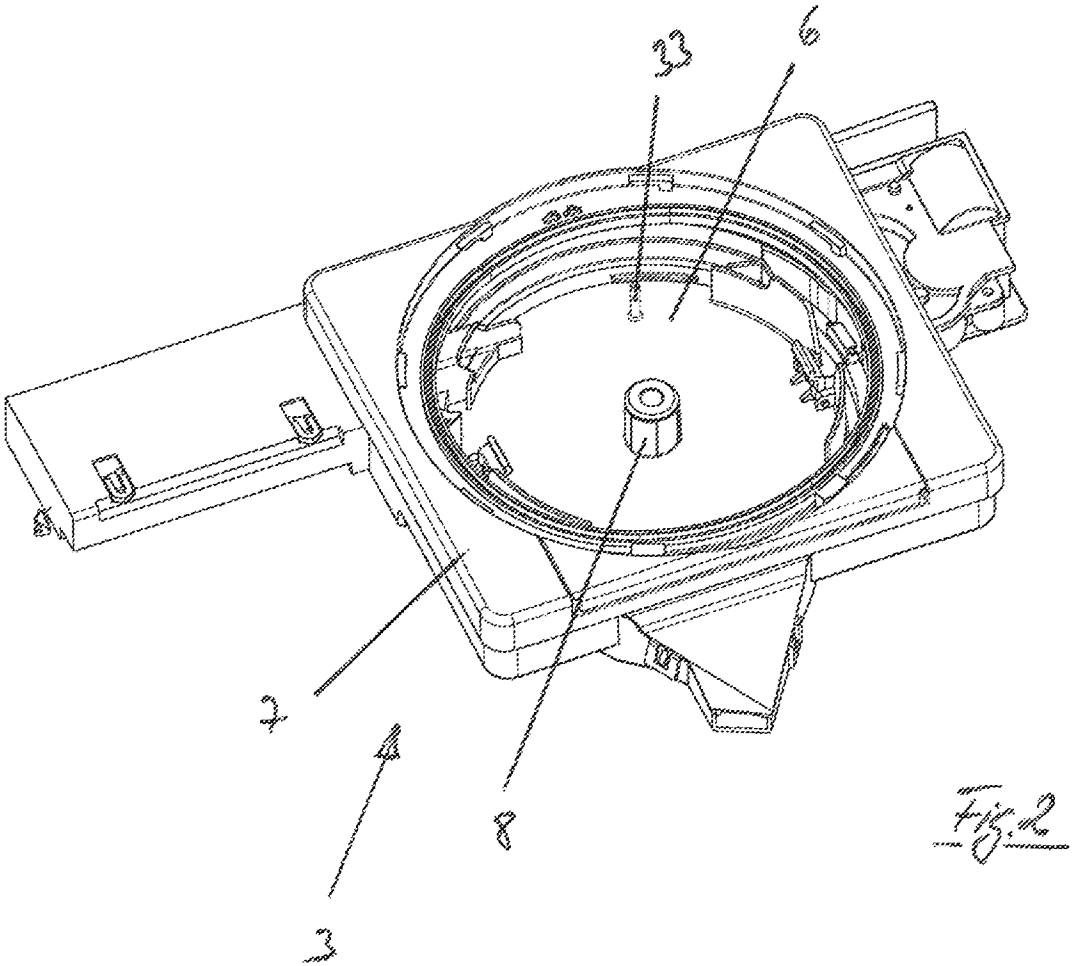
FIG. 2 is a schematic perspective detail view of a dispensing device according to a first embodiment.

FIG. 2 shows a dispensing device 3 according to a first embodiment of the present invention in a schematic perspective detail view, in which closing cover 4 is not shown for the sake of clarity.

As can be seen from the illustration in FIG. 2, dispensing device 3 has a drive device 7. Drive device 7 provides a housing and motor/transmission assembly. Drive device 7 accommodates a carrier unit 6. Drive device 7 allows carrier unit 6 to be rotated in a powered manner, namely about the axis of rotation defined by axle projection 8.

Figure 4:
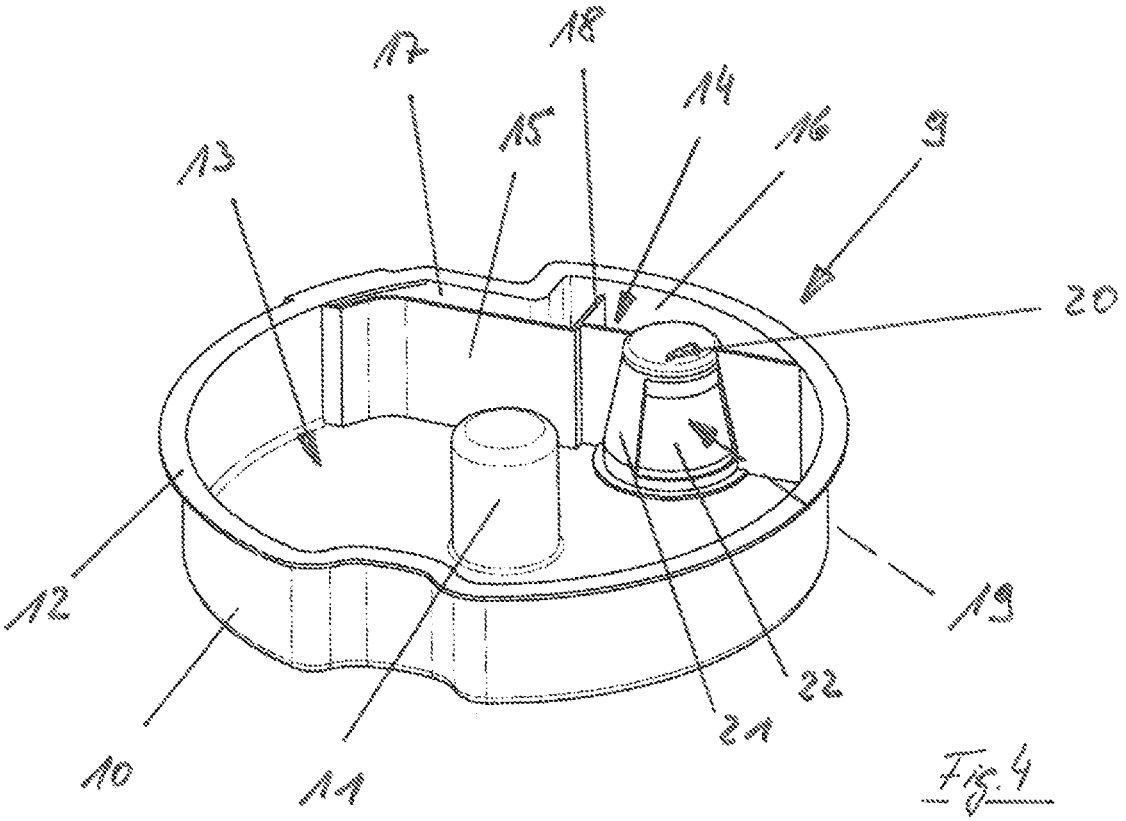
FIG. 4 is a schematic perspective view showing a supply container with a closure device in a first position.

Dispensing device 3 further has a supply container 9, as illustrated, for example, in FIG. 4. Supply container 9 serves to hold an amount of detergent sufficient for a plurality of wash cycles. For each wash cycle, a portioned amount of detergent is withdrawn from the supply container and delivered into washing chamber 103.

Supply container 9 can be replaceably inserted by a user into carrier unit 6 of dispensing device 3. Carrier unit 6 holds supply container 9 in a non-rotatable manner, so that when carrier unit 6 is rotated in a powered manner, supply container 9 accommodated therein is rotated along with it, namely about the axis of rotation defined by axle projection 8.

Figure 5:
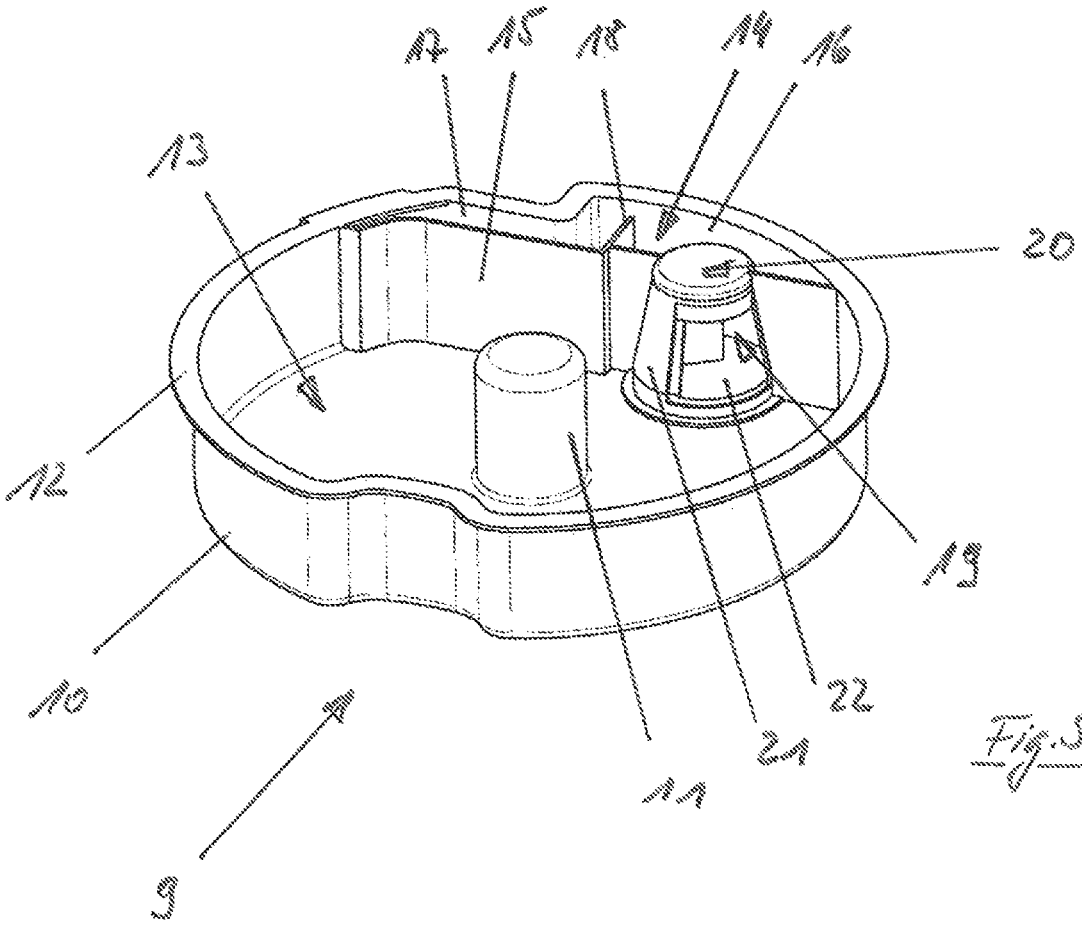
FIG. 5 is a schematic perspective view showing a supply container with a closure device in a second position.
Figure 6:
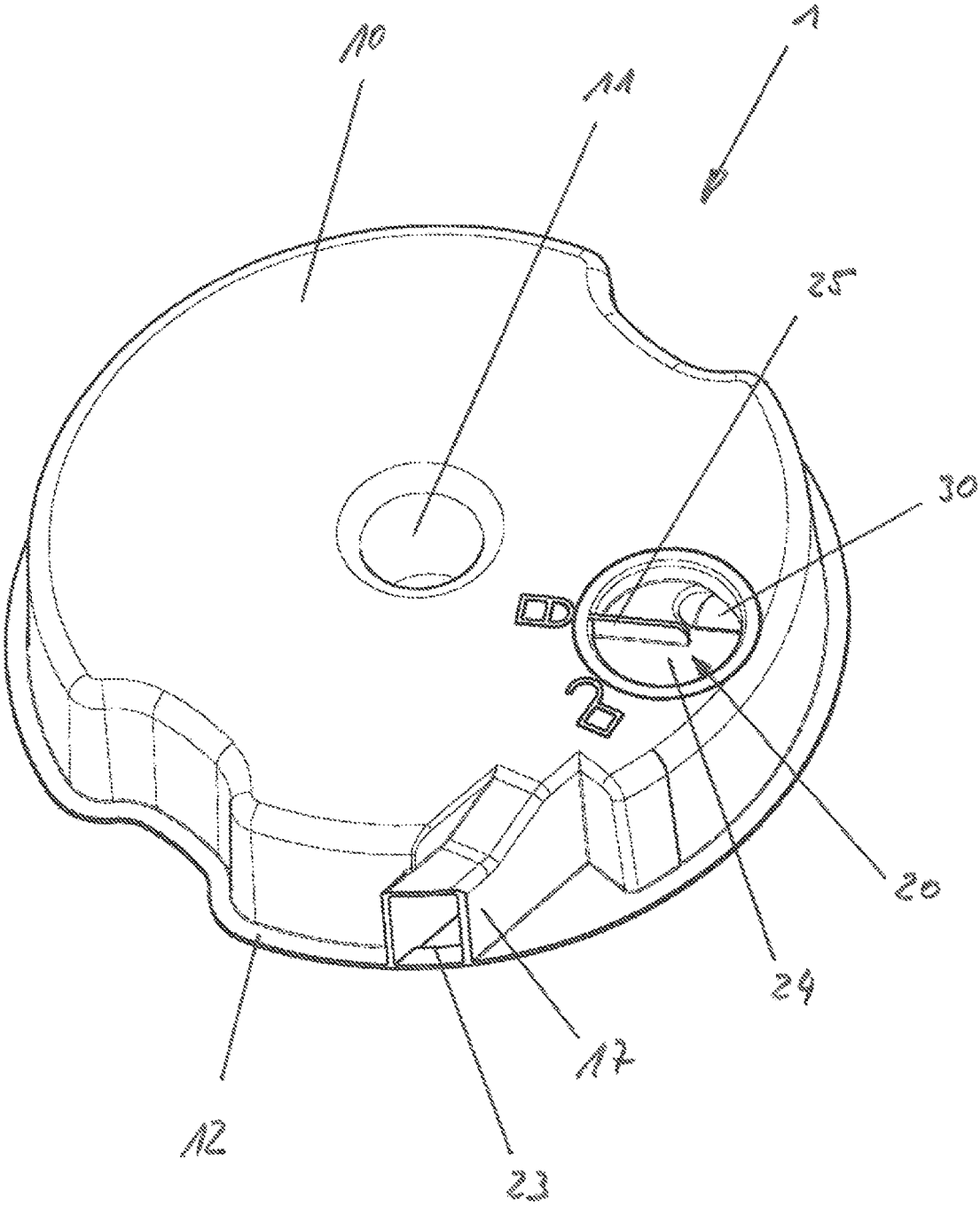
FIG. 6 is a schematic perspective bottom view of the supply container of FIG. 4.

Viewing FIGS. 4, 5 and 6 together, it can be seen that supply container 9 has a main body 10. This main body 10 is provided with a dome 11 which, when supply container 9 is inserted in carrier unit 6, receives the axle projection provided by carrier unit 6, which allows for positionally accurate alignment of supply container 9 relative to carrier unit 6.

Main body 10 further provides a circumferential rim 12, which supports a cover for closing supply container 9 at the top. This cover is preferably a film welded peripherally to rim 12 of the main body.

Main body 10 of supply container 9 provides both a reservoir chamber 13 and a metering chamber 14, which are separated by a dividing wall 15. Reservoir chamber 13 serves for storing detergent, whereas metering chamber 14 serves for dispensing detergent in portions during normal use.

Metering chamber 14 is divided into two sections, namely a first section 16, called metering space, and a second section 17, called dispensing channel. As can be seen particularly in the view of FIG. 6, dispensing channel 17 terminates in dispensing opening 23.

Metering space 16 and dispensing channel 17 are in fluid connection with one another, the fluid connection being narrowed by a dispensing barrier 18, so that an overall labyrinth-like metering chamber 14 is formed.

Reservoir chamber 13 and metering chamber 14 are fluidically connected via a passage opening 19, through which detergent can flow from reservoir chamber 13 into metering chamber 14 during operation. In accordance with the present invention, a closure device 20 is provided which closes passage opening 19 at least until supply container 9 is first put into use.

FIGS. 4 through 6 show a first embodiment of a closure device 20 according to the present invention. FIG. 4 shows closure device 20 in the closed position, and FIG. 5 shows closure device 20 in the open position.

During normal use, with supply container 9 inserted in carrier unit 6, a dispensing operation is performed as follows: Supply container 9 is rotated 360 degrees about the axis of rotation defined by axle projection 8 by means of motor-driven carrier unit 6. In response to this rotation, detergent stored in reservoir chamber 13 is conveyed through passage opening 19 into metering chamber 14. However, due to dispensing barrier 18, only metering space 16 is filled, and thus metering chamber 14 is only partially filled. In any case, dispensing barrier 18 ensures that dispensing channel 17 initially remains free of detergent. The portioned amount of detergent is determined by the volume provided by metering space 16.

As the rotation continues, passage opening 19 comes into a position in which passage opening 19 is located above the pouring level of the detergent stored in reservoir chamber 13, so that no more detergent flows from reservoir chamber 13 into metering space 16. When supply container 9 is in this rotational position, the detergent previously introduced into metering space 16 can flow past dispensing barrier 18 into dispensing channel 17. From there it passes through dispensing opening 23 into treatment chamber 103.

As is apparent from the above explanations, supply container 9 is configured in terms of its geometric shape, in particular with respect to passage opening 19 and dispensing barrier 18, in such a manner that, during a rotation of supply container 9, initially metering space 16 is filled with an amount of detergent determined by the size of metering space 16, and as the rotation continues, the amount of detergent introduced into metering space 16 is conveyed past dispensing barrier 18 into dispensing channel 17 and toward dispensing opening 23 without any additional detergent flowing from reservoir chamber 13 into metering space 16.

In accordance with the present invention, passage opening 19 is closed by a closure device 20 at least until supply container 9 is first put into use. In this manner, it is ensured that before first use, the detergent held in supply container 9 is only present in reservoir chamber 13; i.e., that the detergent is prevented from flowing into metering chamber 14. Thus, in the event of unwanted ingress of moisture into supply container 9, unwanted clumping of detergent may occur only in reservoir chamber 13, but not in metering chamber 14. This is an advantage because any lumps of detergent which may form in reservoir chamber 13 are less detrimental since such lumps are broken up during operational rotation of a supply container 9 inserted in carrier unit 6. Also, there is no risk of clogging of dispensing channel 17.

FIGS. 4, 5 and 6 are different views of supply container 9, showing a first embodiment of a closure device 20 according to the present invention. This closure device 20 has a cylindrical housing 21 having a rotatable member 22 inserted therein. Depending on the position of rotatable member 22, passage opening 19 is either open (FIG. 5) or closed (FIG. 4).

Figure 7:
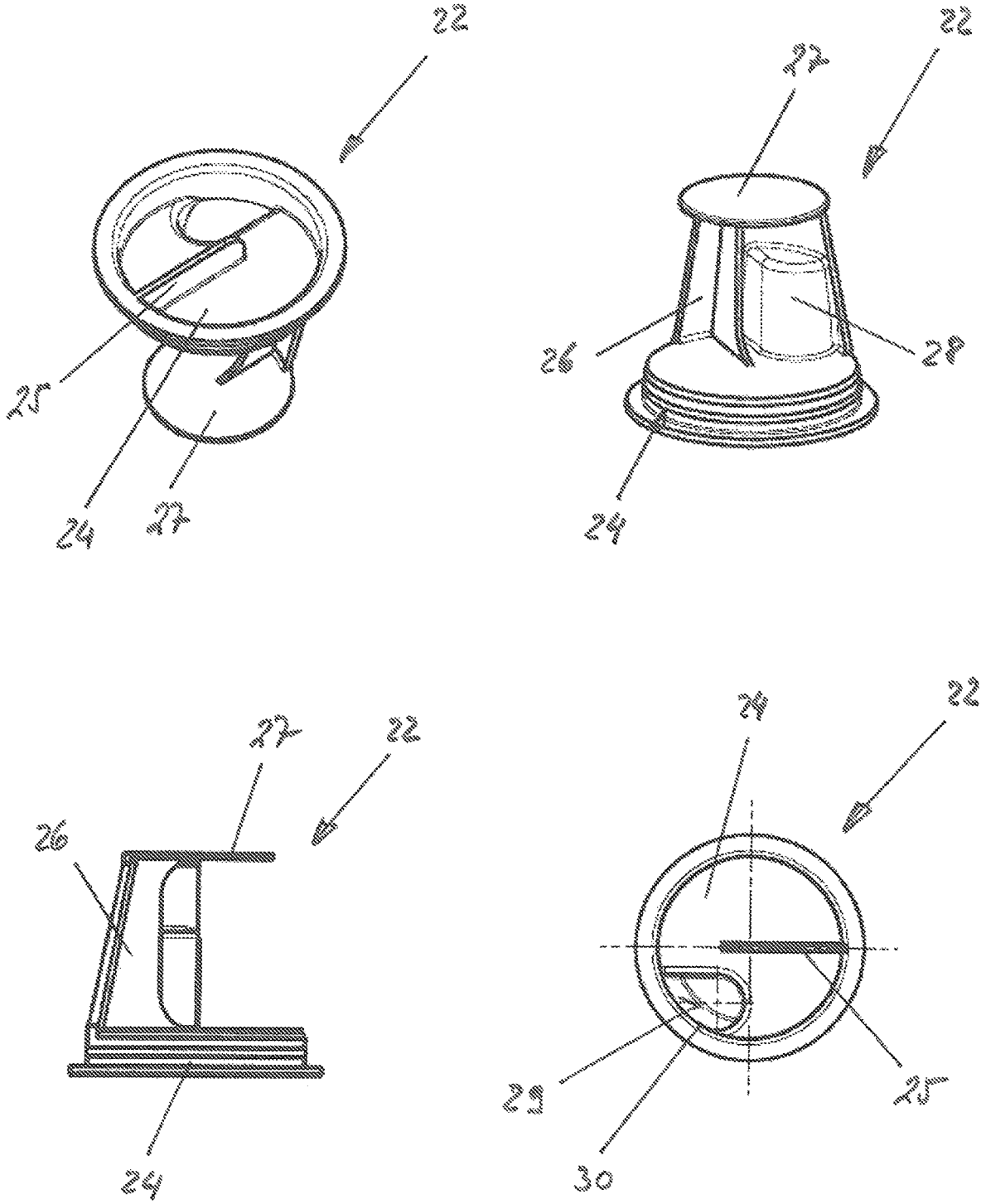
FIG. 7 shows a closure device according to a first embodiment from different perspectives.

FIG. 7 shows different views of rotatable member 22. Rotatable member 22 includes a rotatable disk 24 and a guide disk 27, a wall portion being disposed between rotatable disk 24 and guide disk 27.

As can be seen from the illustration in FIG. 6, the bottom of main body 10 of supply container 9 has an opening in which rotatable member 22 is inserted when in the proper position. Rotatable disk 24 provides guidance of rotatable member 22 relative to the bottom of main body 10. At the housing end, rotatable member 22 is guided by guide disk 27, so that rotatable member 22 can be rotated relative to main body 10.

To make it easier for a user to rotate rotatable member 22, rotatable disk 24 is provided on its underside with a handle 25 in the form of a web, as can be seen particularly from the view of FIG. 6. The position of handle 25 may also serve as a visual indication to a user of whether closure member 20 is in the closed position or in the open position, as indicated by the lock symbol in FIG. 6.

When closure device 20 is in the closed position, then wall portion 26 is positioned such that passage opening 19 is closed. In the open position, closure device 20 is rotated to a point where wall portion 20 clears passage opening 19.

To ensure that supply container 9 can only be inserted in carrier unit 6 when closure member 20 is in the open position, the carrier unit 6 according to the first exemplary embodiment shown in FIG. 2 has a coding element in the form of a pin 33. This pin 33 cooperates with an indentation 28 in wall portion 26 of rotatable member 22, the indentation being accessible via an opening 30, as can be seen particularly when viewing the representations shown in FIG. 7 together. It is only when rotatable member 22 is in the open position that indentation 28 is positioned relative to pin 33 in such a manner that supply container 9 can be inserted into carrier unit 6. However, when rotatable member 22 is in the closed position, it is not possible to insert supply container 9 into carrier unit 6 because pin 33 cannot enter indentation 28 and, therefore, supply container 9 is blocked from being inserted into carrier unit 6.

Figure 3:
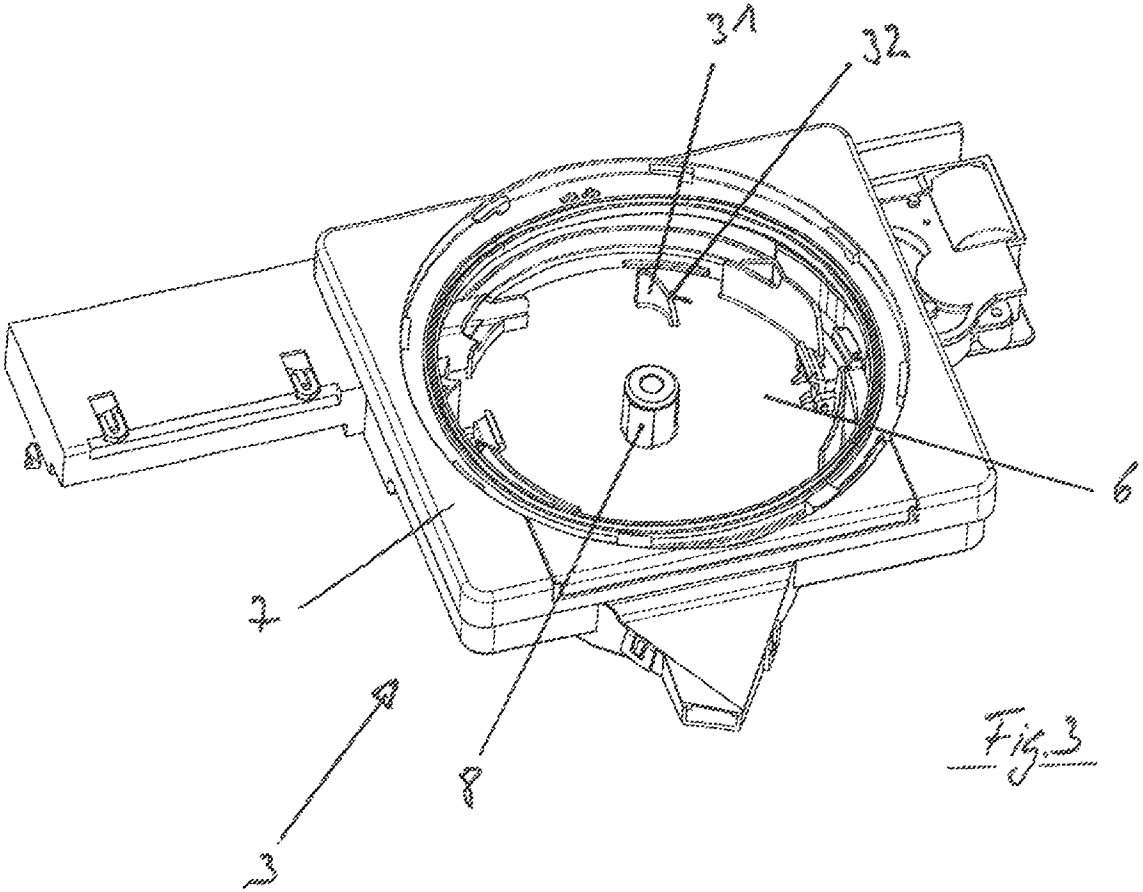
FIG. 3 is a schematic perspective detail view of a dispensing device according to a second embodiment.

FIG. 3 shows a second embodiment, where a cam 31 having a cam contour 32 is used in place of pin 33. This cam contour 32 provided by cam 31 cooperates with a correspondingly shaped mating contour within indentation 28. As can be seen from the illustration in FIG. 3, cam counter 32 is ramp-shaped. As a result, during insertion of supply container 9, rotatable member 2 is automatically opened if it is still in the closed position. This automatic opening is achieved by the mating contour of indentation 28 sliding along ramp-shaped cam contour 32 and coming into force-transmitting relationship with cam 31, as a result of which rotatable member 22 is automatically rotated in response to insertion of supply container 9 into carrier unit 6. Thus, in this embodiment, it is irrelevant whether closure device 20 is in its open position or in its closed position. Automatic opening occurs when a user inserts supply container 9 into carrier unit 6.

Figure 8:
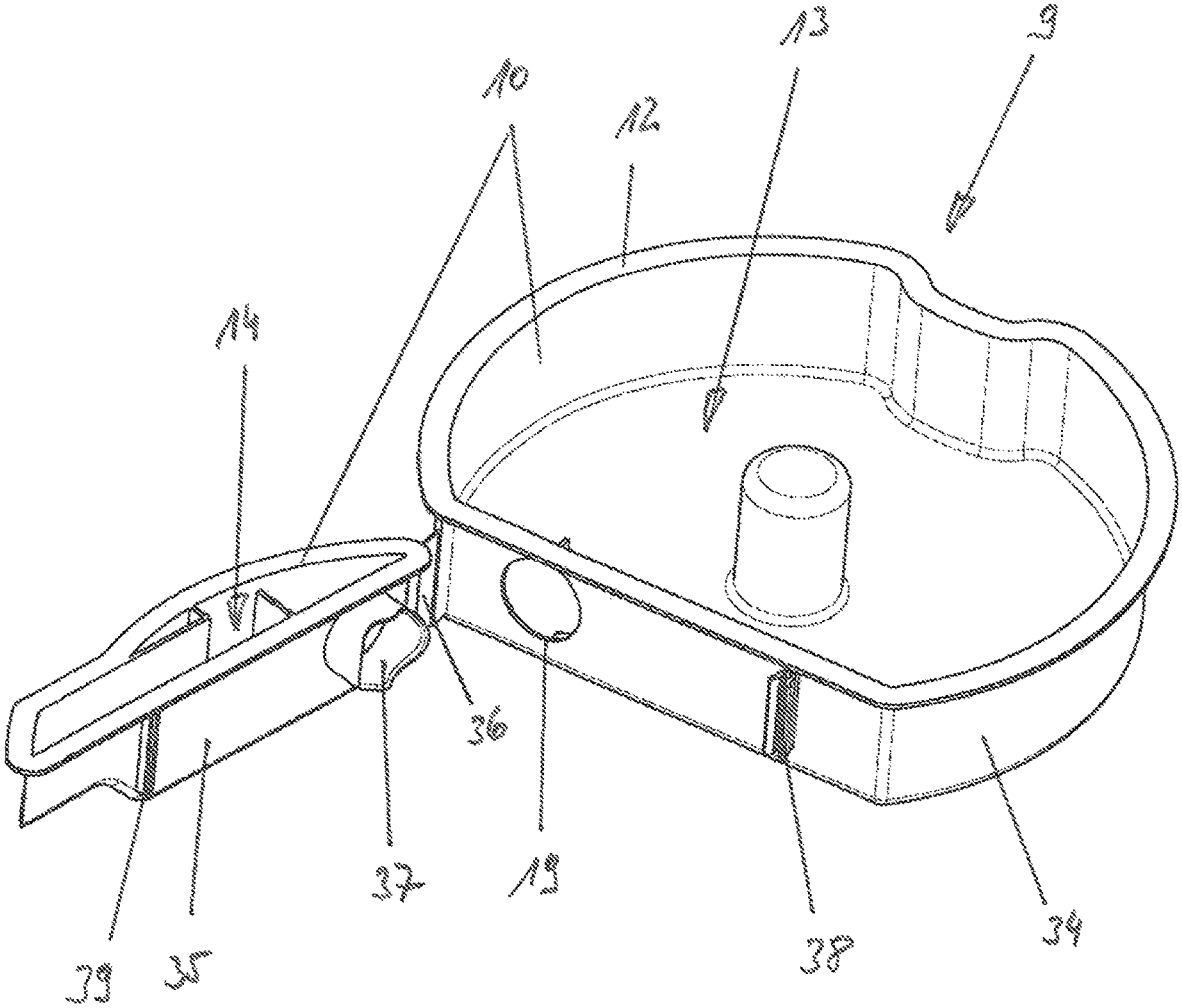
FIG. 8 is a schematic perspective view showing a supply container according to a third embodiment in a first position.
Figure 9:
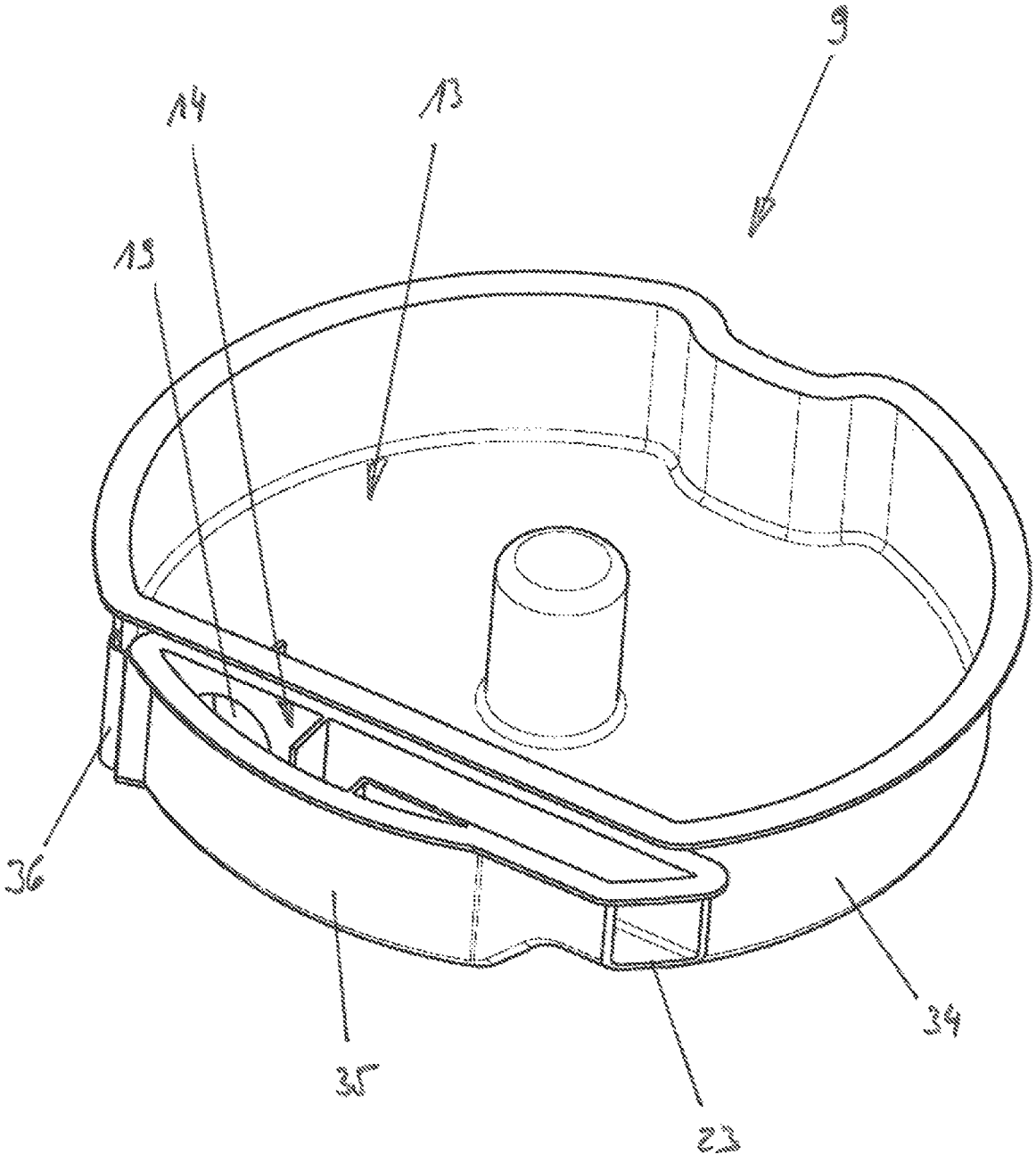
FIG. 9 is a schematic perspective view showing a supply container according to a third embodiment in a second position.

FIGS. 8 and 9 show a third embodiment of the present invention where main body 10 of supply container 9 is divided into two parts, namely a first container part 34 and a second container part 35. First container part 34 provides reservoir chamber 13 and second container part 35 provides metering chamber 14.

The two container parts 34 and 35 are pivotable relative to each other. To this end, a film hinge 36 is provided.

Passage opening 19 is closed by a closure device in the form of a sealing film. In order to make supply container 9 ready for first use, second container part 35 has to be pivoted relative to first container part 34 into the position shown in FIG. 9. In this position, web 39 provided by second container part 35 is latched with a catch 38 provided by first container part 34, thereby securely fixing first and second container parts 34 and 35 in position.

As can be seen from the illustration in FIG. 8, second container part 35 has a seal-destroying device in the form of a short tubular projection 37. As second container part 35 is moved from the position shown in FIG. 8 to the position shown in FIG. 9, this short tubular projection 37 engages into passage opening 19, thereby breaking open the sealing film that closes passage opening 19.

The embodiment according to FIGS. 8 and 9 has the particular advantage of being relatively inexpensive to manufacture. However, it is not possible to reclose passage opening 19 because the sealing film closing passage opening 19 until first use has to be broken open for purposes of first use.

The embodiment according to FIGS. 4 through 7 has the advantage that passage opening 19 is reclosable, which makes it possible to remove a not yet emptied supply container 9 from carrier unit 6 and close passage opening 19. Thus, supply container 9 can be set aside and stored for reuse.

FIGS. 10 through 20 show a supply container for a dispensing device according to a fourth embodiment of the present invention. Viewing FIGS. 10 through 13 together, it can be seen that supply container 9 has a main body 10. This main body 10 is provided with a dome 11 which, when supply container 9 is inserted in carrier unit 6, receives the axle projection provided by carrier unit 6, which allows for positionally accurate alignment of supply container 9 relative to carrier unit 6.

Main body 10 further provides a circumferential rim 12, which supports a film 426 for closing supply container 9 at the top. Preferably, film 426 is welded peripherally to rim 12 of the main body.

Main body 10 of supply container 9 provides both a reservoir chamber 13 and a compartment 425, which are separated by a dividing wall 15. Reservoir chamber 13 serves for storing detergent, whereas compartment 425 serves to receive a metering element 422 which, in turn, provides a metering chamber 14 which serves for dispensing detergent in portions during normal use. As can be seen particularly in the cross-sectional view of FIG. 15, metering chamber 14 provides a so-called metering space, which is narrowed by a dispensing barrier 18, so that an overall labyrinth-like metering chamber 14 is formed which, during operation, provides for the portioning of the detergent to be released into the treatment chamber.

In the exemplary embodiment shown, a dispensing channel 17 provided by supply container 9 is disposed downstream of metering chamber 14 in fluid connection therewith, dispensing channel 17 terminating in dispensing opening 423. Thus, detergent released from reservoir chamber 13 may flow through metering chamber 14 into dispensing channel 17 and via dispensing opening 423 toward the treatment chamber of the dishwasher.

Figure 11:
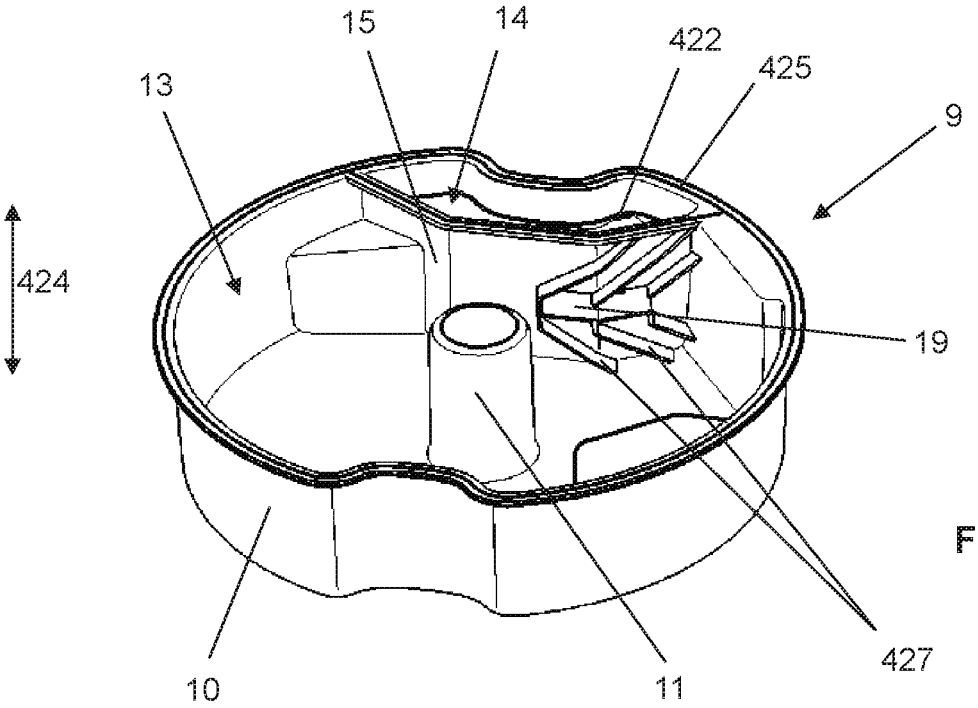
FIG. 11 is a schematic view showing the supply container of FIG. 10 with a metering element in the non-metering position.
Figure 12:
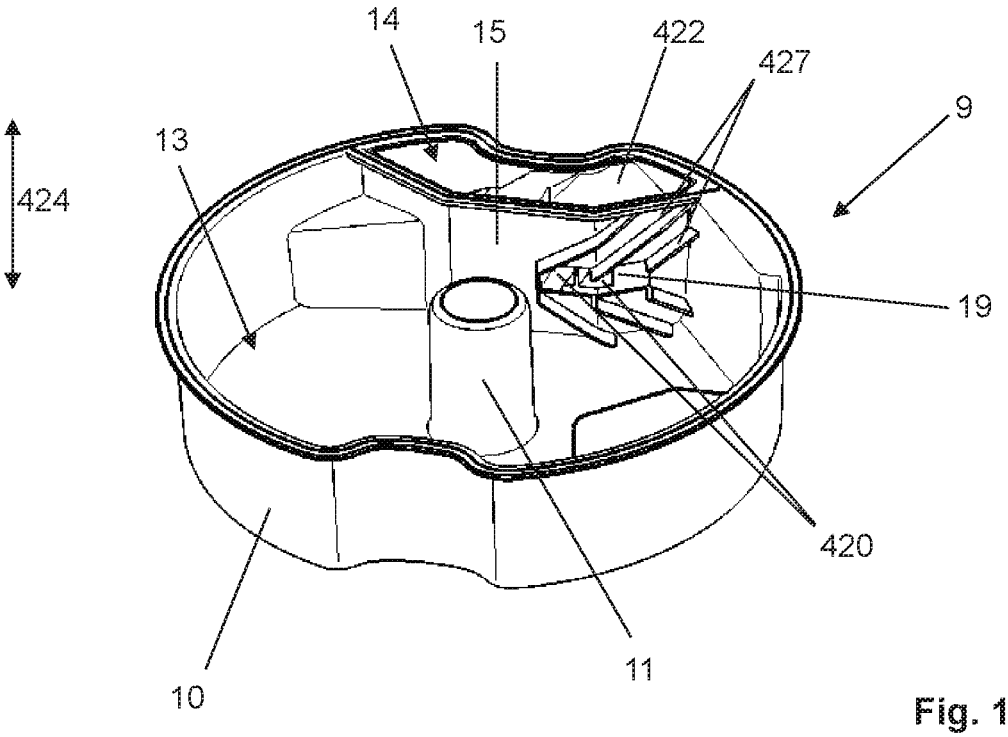
FIG. 12 is a view showing the supply container of FIG. 11 with a metering element in the metering position.
Figure 13:
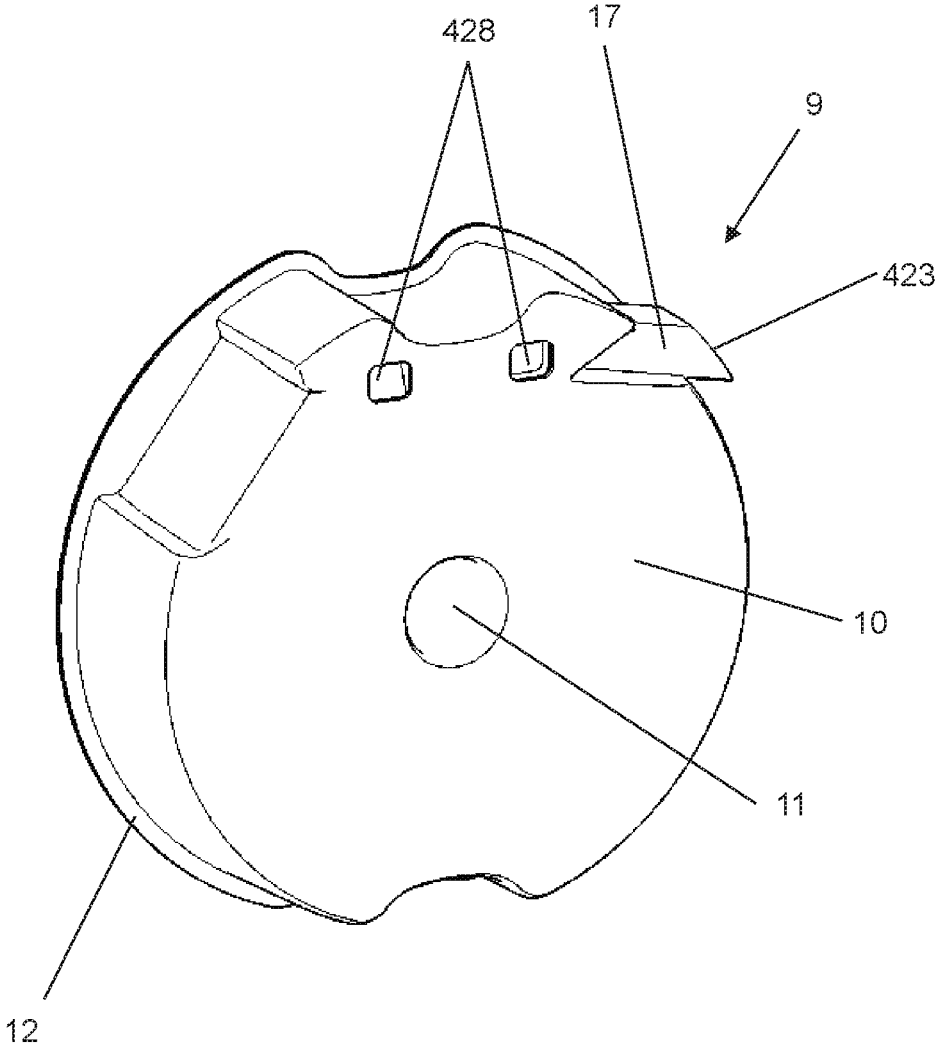
FIG. 13 is a rear view of the supply container of FIG. 10.
Figure 14:
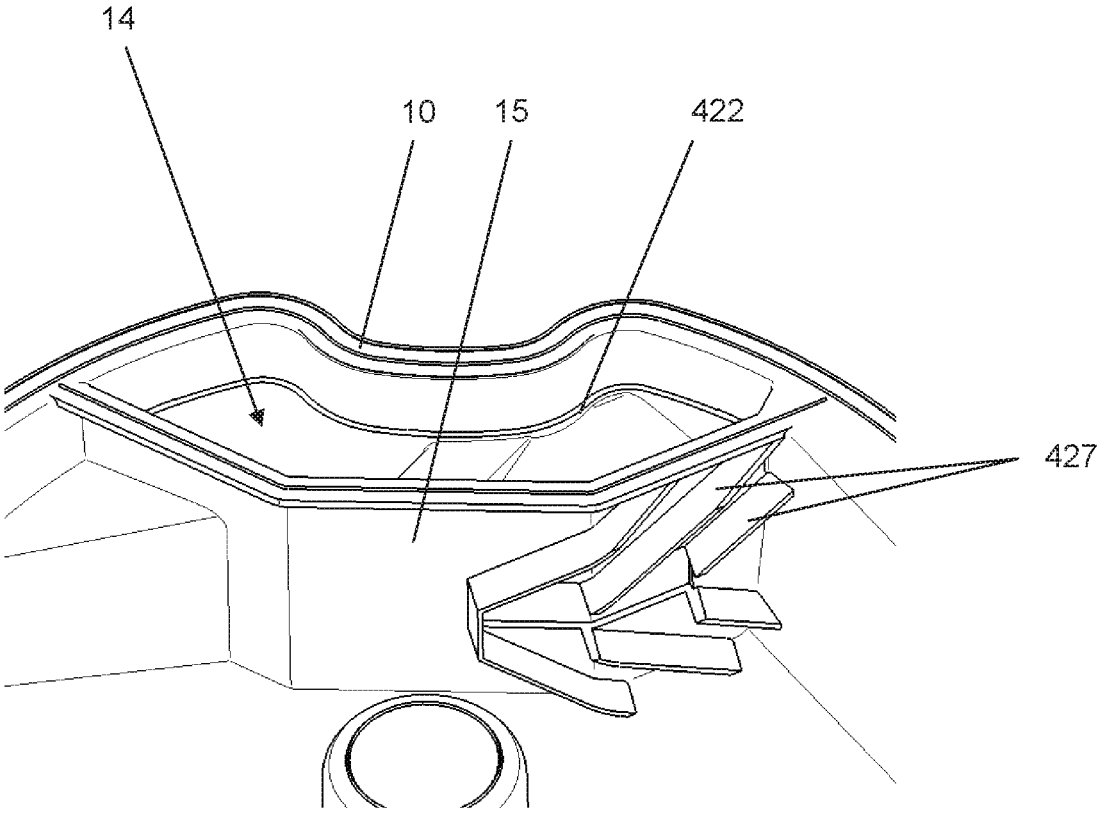
FIG. 14 is a schematic perspective detail view of the supply container of FIG. 10.
Figure 15:
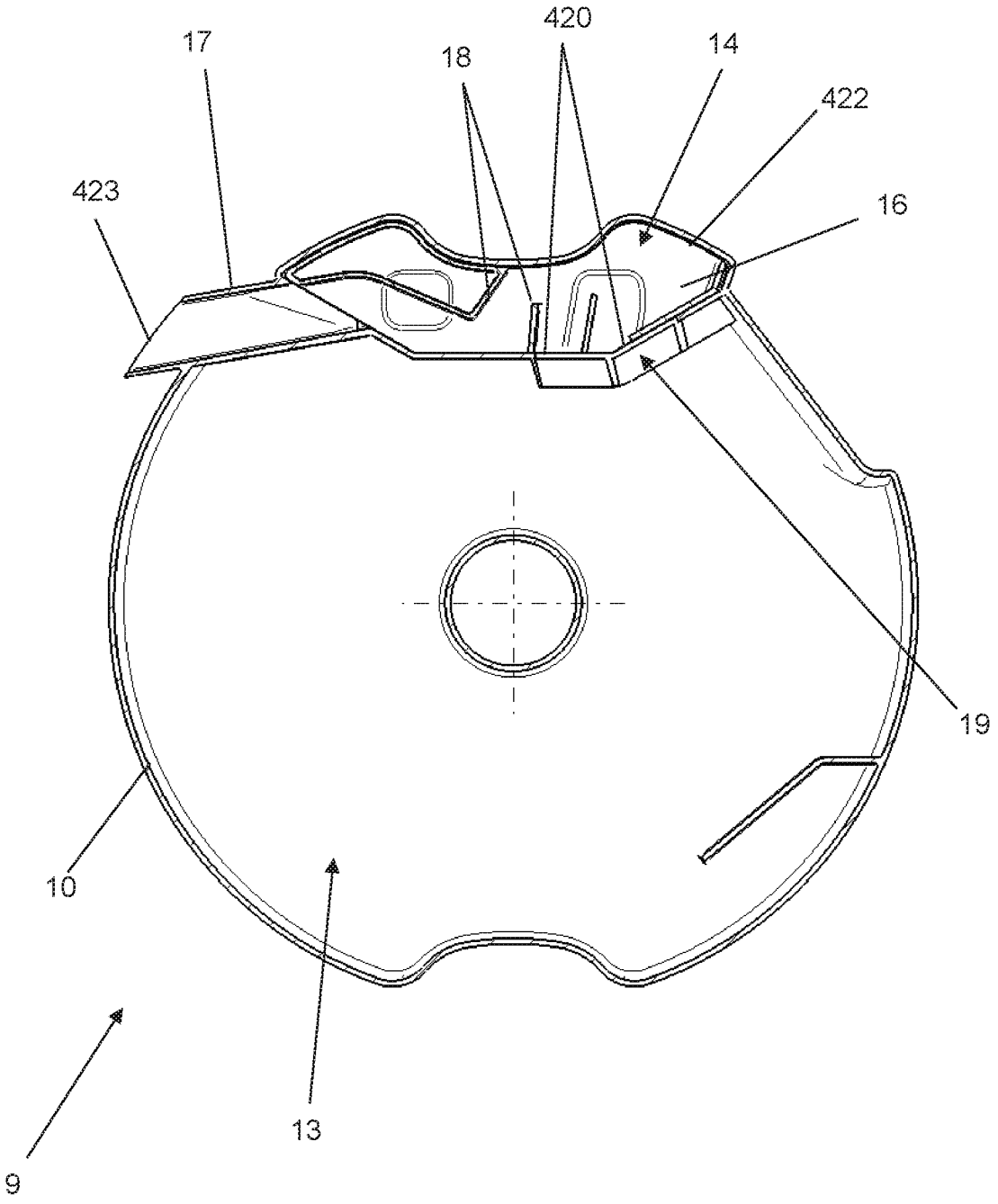
FIG. 15 is a cross-sectional top view of the supply container of FIG. 10.

As is apparent, in particular, when viewing FIGS. 11 and 12 together, metering element 422, which is received in compartment 425 and provides metering chamber 14, can assume two positions in relation to main body 10 of supply container 9. For this purpose, metering element 422 can be moved in height direction 424.

FIG. 11 shows metering element 422 in its non-metering position. In contrast, FIG. 12 depicts a metering element 422 which has been moved upward in height direction 424 to a position in which it is in its metering position.

To permit detergent to be conveyed from reservoir chamber 13 into metering chamber 14, main body 10 of supply container 9 has an outlet opening 19, which is surrounded by ribs 427 disposed in a funnel-like arrangement to facilitate the conveyance of detergent into metering chamber 14.

In the exemplary embodiment shown, metering element 422 is provided with two inlet openings 420 corresponding to outlet opening 19. Inlet openings 420 come into register with outlet opening 19 when dispensing element 422 is in its metering position, as shown in FIG. 12. In the non-metering position shown in FIG. 11, inlet openings 420 come to rest below outlet opening 19 in height direction 424, so that they are closed by the closure element provided by dividing wall 15 between reservoir chamber 13 and compartment 425.

Actuating device 421 provided on the carrier unit serve to permit metering element 422 to be moved from the non-metering position shown in FIG. 11 to the metering position shown in FIG. 12 when supply container 9 is inserted for the first time into carrier unit 7. In the exemplary embodiment shown, actuating device 421 are configured as pins, as can be seen, in particular, in FIGS. 16 and 17. During normal use, these actuating device 421 engage into openings 428 (most clearly shown in FIG. 13) formed in the bottom of main body 10 of supply container 9.

Figure 16:
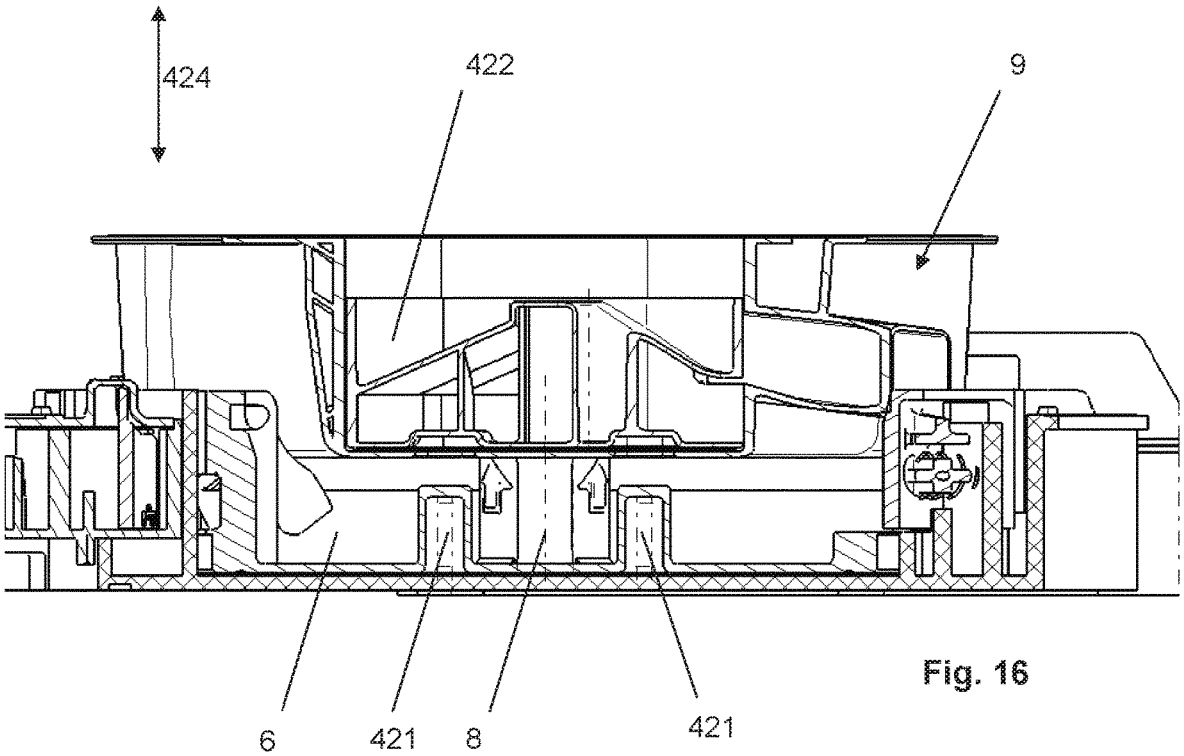
FIG. 16 is a cross-sectional view of the inventive dispensing device according to the fourth embodiment with the supply container shown in a non-inserted position.
Figure 17:
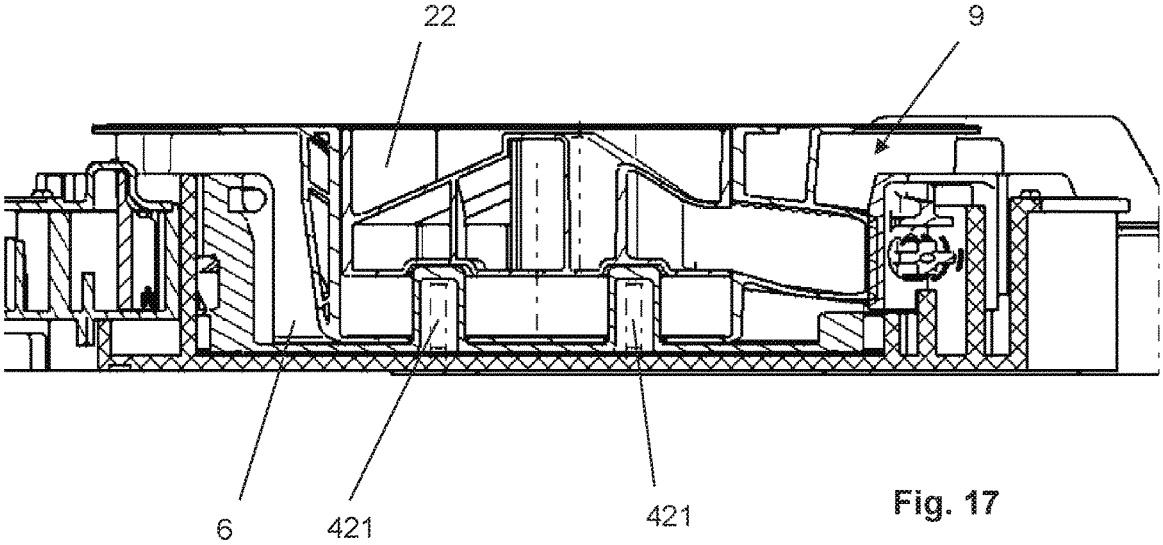
FIG. 17 is a view showing the dispensing device of FIG. 16 with the supply container in the inserted position.

The cross-sectional view of FIG. 16 shows dispensing device 3 in a condition in which supply container 9 has not yet been inserted. In this condition of dispensing device 3, metering element 422 is still in its non-metering position. As soon as supply container 9 is properly inserted downwardly into carrier unit 6 in height direction 424, actuating device 421 of dispensing device 3, which are configured as pins, pass through openings 428 provided on the supply container, thereby coming into contact with metering element 422. When supply container 9 is moved further downward in height direction 424 and properly inserted into carrier unit 6, metering element 422 received in compartment 425 is driven (i.e., moved) upward in height direction 424, so that, when supply container 9 is properly inserted in dispensing device 3, metering element 422 is in its metering position shown in FIG. 12, as can also be seen from the illustration in FIG. 17.

The supply container shown in FIGS. 10 through 17 is designed as a disposable container; i.e., it cannot be refilled with detergent by a user. An alternative variant can be seen in FIGS. 18 through 20, which show a reusable supply container that can be refilled by a user.

Figure 18:
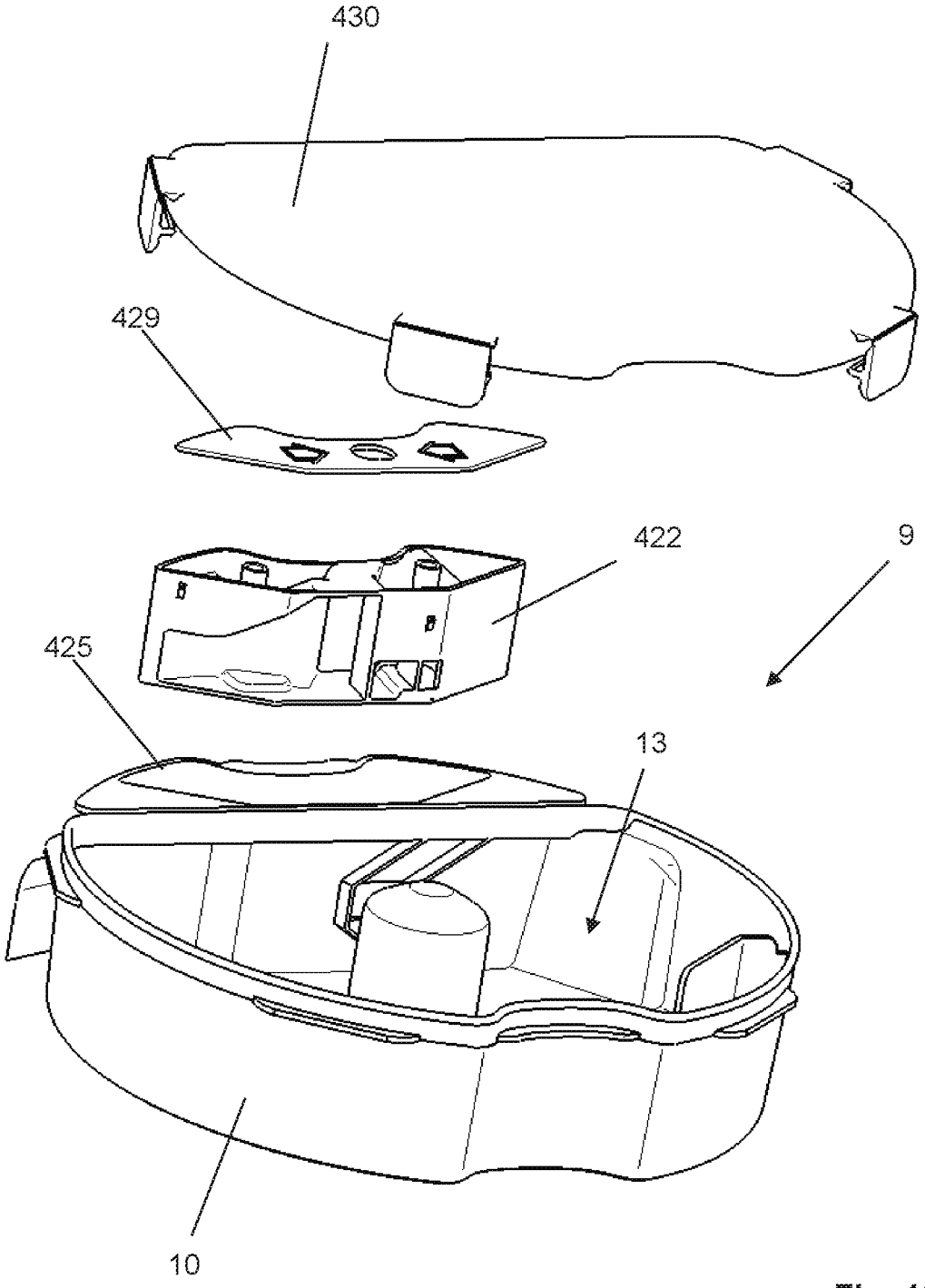
FIG. 18 is a schematic exploded view of an inventive supply container according to a second variant of the fourth embodiment.
Figure 19:
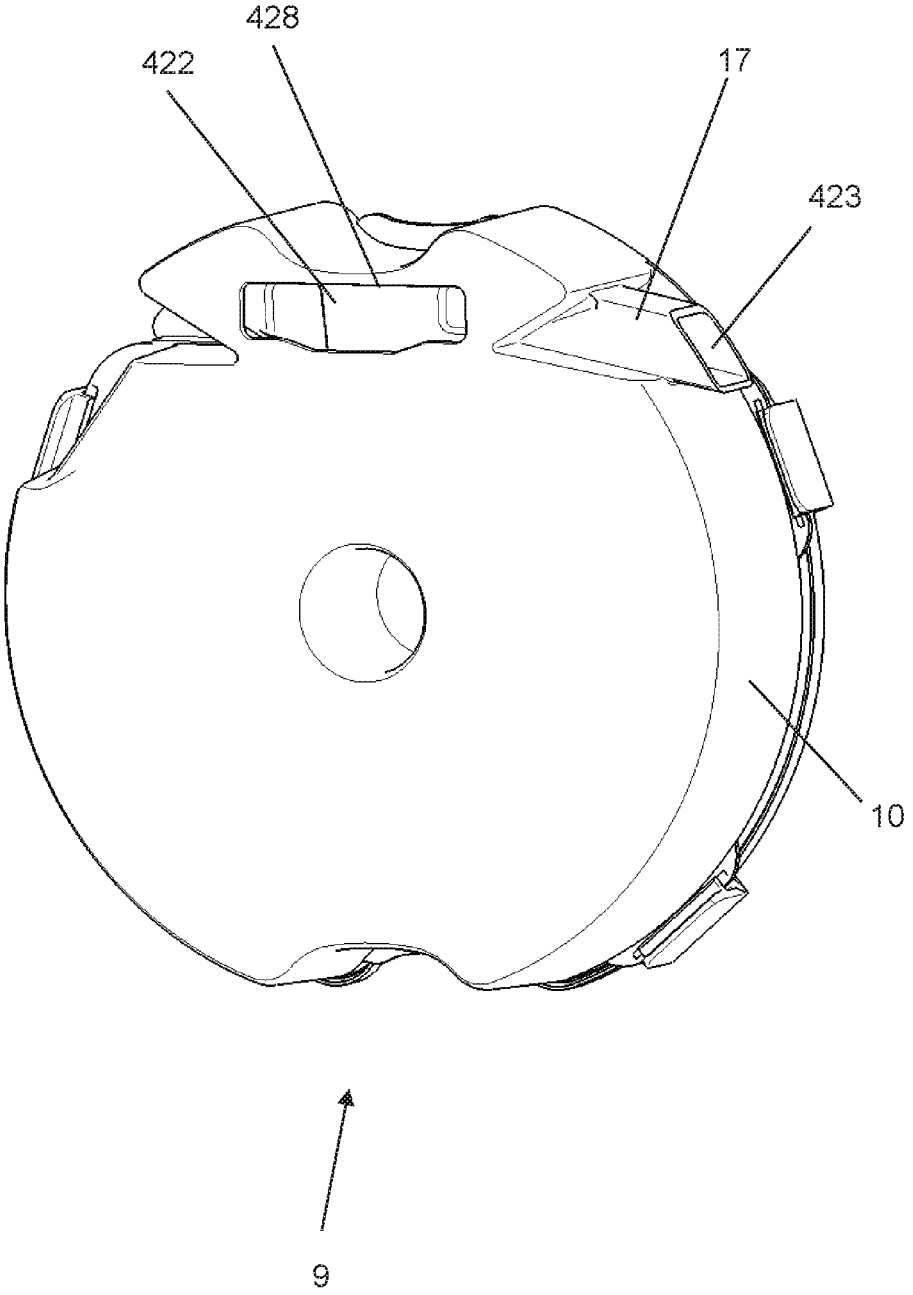
FIG. 19 is a rear view of the supply container of FIG. 18.
Figure 20:
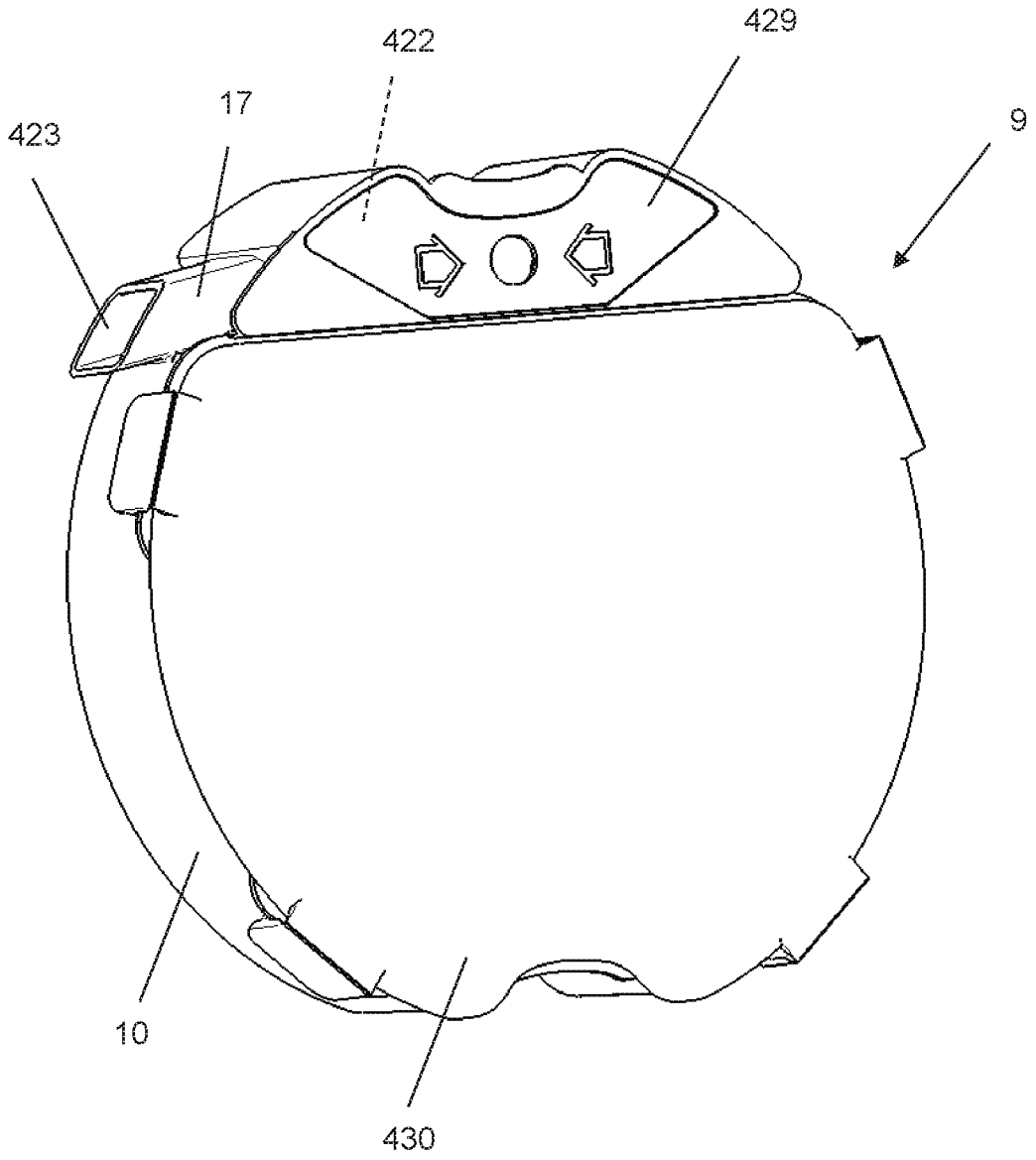
FIG. 20 is a schematic plan view showing the supply container of FIG. 18 from above.
Figure 21:
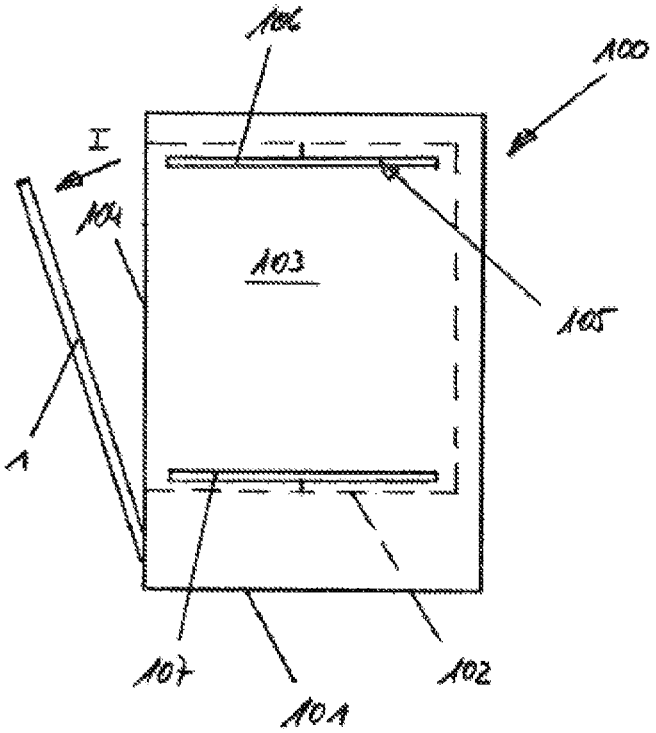
FIG. 21 is a schematic side view of a cleaning appliance in the form of a dishwasher 100.

The supply container embodied as shown in FIGS. 18 through 20 does not have a welded-on film 426, but a cover 430 which can be removed from main body 10 of supply container 9 by a user for access to reservoir chamber 13. Accordingly, the supply container can be refilled with detergent when cover 430 is removed. Once refilling is complete, cover 430 has to be placed back onto main body 10 to close supply container 9.

Since, in contrast to the aforedescribed embodiment, there is no film 426 that would also cover metering element 422, a separate cover 429 is provided for closing metering element 422. This cover can also be removed by a user, so that metering element 422 can be cleaned if necessary.

In the alternative embodiment, opening 428 cooperating with actuating device 421 provided on the carrier unit is comparatively large, as can be seen in the rear view of FIG. 19. Preferably, opening 428 is of a size sufficient to allow a user to pass a finger or an auxiliary device therethrough in order to push metering element 422 upwardly out of compartment 425. This allows the metering element to be removed from supply container 9 for manual cleaning.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 washing chamber door
2 inner side
3 dispensing device
4 closing cover
5 dispensing outlet
6 carrier unit
7 drive device
8 axle projection
9 supply container
10 main body

11 dome
12 rim
13 reservoir chamber
14 metering chamber
15 dividing wall
16 first section (metering space)
17 second section (dispensing channel)
18 dispensing barrier
19 passage opening
20 closure device
21 housing
22 rotatable member
23 dispensing opening
24 rotatable disk
25 handle
26 wall portion
27 guide disk
28 indentation
29 guide contour
30 opening
31 cam
32 cam contour
33 pin
34 first container part
35 second container part
36 film hinge
37 short tubular projection
38 catch
39 web
40 combination device
41 rinse aid reservoir
42 supply container
100 dishwasher
101 housing
102 washing tub
103 washing chamber
104 loading opening
105 spray device
106 spray arm
107 spray arm
420 inlet opening
421 actuating device
422 metering element
423 dispensing opening
424 height direction
425 compartment
426 film
427 rib
428 opening
429 cover
430 cover

What is claimed is:

1. A dispensing device for introducing a pourable detergent in metered amounts into a treatment chamber of a program-controlled cleaning appliance, the dispensing device comprising:

a supply container for holding the detergent, the supply container having a reservoir chamber and a metering chamber terminating in a dispensing opening, the metering chamber being fluidically connected to the reservoir chamber via an interposed passage opening;

a carrier unit which is rotatable by a motor and replaceably receives the supply container; and a closure device configured to close the passage opening at least until the supply container is first put into use, wherein the carrier unit has an opening means configured to cooperate with the closure device.

2. The dispensing device as recited in claim 1, wherein the closure device has a closure element which is movably disposed on the supply container and is movable from a closed position to an open position and vice versa.

3. The dispensing device as recited in claim 2, wherein the closure element comprises a wall portion which in shape corresponds to the passage opening and is disposed on a rotatable disk.

4. The dispensing device as recited in claim 1, wherein the closure device comprises a sealing film.

5. The dispensing device as recited in claim 4, wherein the sealing film is disposed at one end of a tab whose other end extends through the dispensing opening.

6. The dispensing device as recited in claim 1, wherein the supply container has a first container part providing the reservoir chamber and a second container part providing the metering chamber, the two container parts being movable relative to each other.

7. The dispensing device as recited in claim 6, wherein the two container parts are pivotable relative to each other via a film hinge interposed therebetween.

8. The dispensing device as recited in claim 6, wherein one of the two container parts has a seal-destroying device configured to cooperate with the passage opening provided by the other one of the container parts.

9. The dispensing device as recited in claim 8, wherein the seal-destroying device comprises a short tubular projection.

10. A dispensing device for introducing a pourable detergent in metered amounts into a treatment chamber of a program-controlled cleaning appliance, the dispensing device comprising:

a supply container for holding the detergent, the supply container having a reservoir chamber and a metering chamber terminating in a dispensing opening, the metering chamber being fluidically connected to the reservoir chamber via an interposed passage opening;

a carrier unit which is rotatable by a motor and replaceably receives the supply container; and a closure device configured to close the passage opening at least until the supply container is first put into use, wherein the carrier unit has a coding device configured to cooperate with the closure device.

11. A dispensing device for introducing a pourable detergent in metered amounts into a treatment chamber of a program-controlled cleaning appliance, the dispensing device comprising:

a supply container for holding the detergent, the supply container having a reservoir chamber and a metering chamber terminating in a dispensing opening, the metering chamber being fluidically connected to the reservoir chamber via an interposed passage opening;

a carrier unit which is rotatable by a motor and replaceably receives the supply container; and a closure device configured to close the passage opening at least until the supply container is first put into use, wherein the carrier unit has an opening means configured to cooperate with the closure device, and wherein the opening means comprises a cam having a ramp-shaped cam contour on a supply container side, the ramp-shaped cam contour cooperating with a mating contour provided by the closure device.

* * * * *